US005078760A

United States Patent [19]

Haldipur et al.

[11] Patent Number: 5,078,760

[45] Date of Patent: Jan. 7, 1992

[54] SEPARATION OF PARTICULAYE FROM GASES PRODUCED BY COMBUSTION OF FOSSIL MATERIAL

[75] Inventors: Gaurang B. Haldipur, Monroeville; William J. Dilmore; Thomas E. Lippert, both of Murrysville, all of Pa.

[73] Assignee: Westinghouse Electric Corp., Pittsburgh, Pa.

[21] Appl. No.: 653,934

[22] Filed: Feb. 11, 1991

[51] Int. Cl.[5] ..... B01D 46/04

[52] U.S. Cl. ..... 55/96; 55/302; 55/337; 55/523

[58] Field of Search ..... 55/96, 302, 337, 484, 55/523

[56] References Cited

U.S. PATENT DOCUMENTS

| | | | |
|---|---|---|---|
| 3,920,426 | 11/1975 | Tu et al. | 55/337 |
| 4,237,800 | 12/1980 | Kullendorff et al. | 55/337 X |
| 4,343,631 | 8/1982 | Ciliberti | 55/302 |
| 4,718,924 | 1/1988 | DeMarco | 55/302 |
| 4,973,459 | 11/1990 | Lippert et al. | 55/523 X |

*Primary Examiner*—Charles Hart

[57] ABSTRACT

Apparatus and method for separating particulate from gas produced by combustion of fossil fuel including a main vessel having a lower compartment in which the fuel is burned and an upper compartment in which the separation of particulate takes place. The separation is effected by combining roughing cyclones for separating the larger particulate with modules of cross-flow filters for separating the residual smaller particulate which emerges from the cyclones. The upper compartment includes a plurality of pressure vessels each containing a cyclone and modules of cross-flow filters mounted vertically. In each module the cross-flow filters are divided into an upper cluster, middle cluster and a bottom cluster. In each of the upper and middle clusters the cross-flow filters are arrayed or stacked vertically in columns in T configuration. In the bottom cluster the filters are arrayed in cruciform configuration. Each cluster has a separate pipe for conducting gas processed by the cross-flow filters out and pulses for cleaning the cross-flow filters in. The cleaning gas is conducted in succession through the separate pipes. The middle cluster is rotated about 120° about its vertical axis with respect to the upper cluster to afford clearance for the respective pipes from these clusters. The vertical axes of the pipes from the three clusters are spaced by 120° from each other.

30 Claims, 12 Drawing Sheets

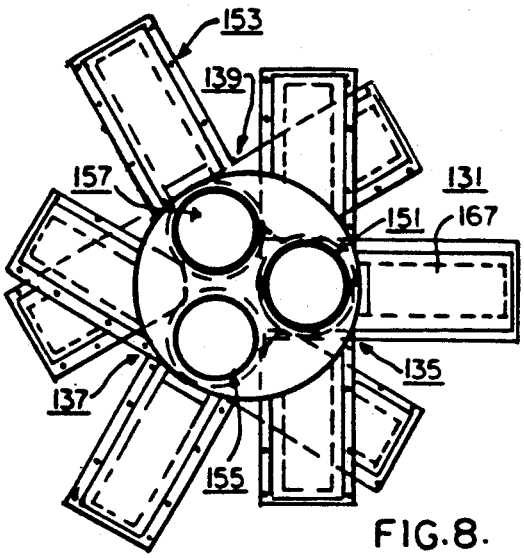
FIG.8.
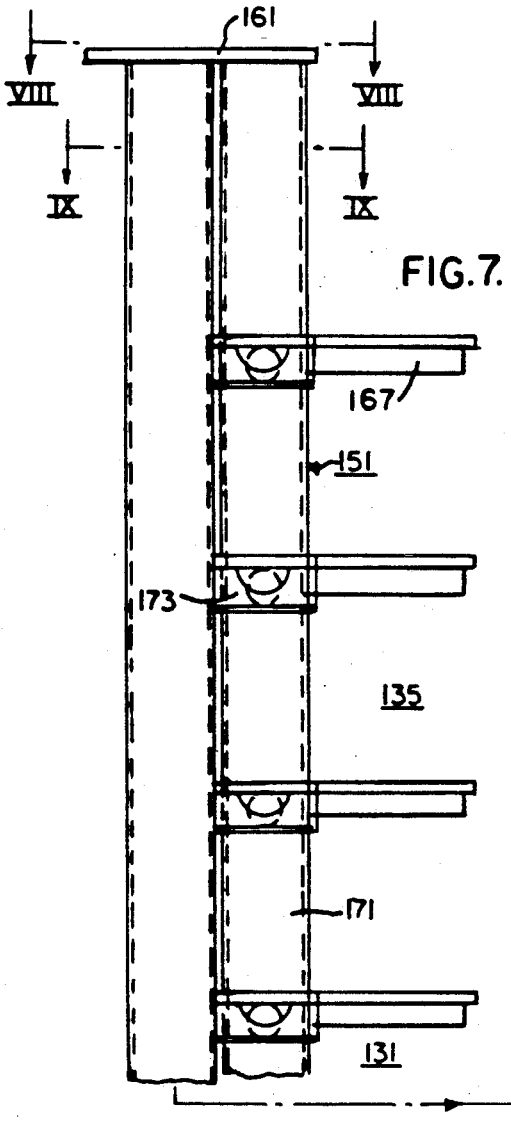
FIG.7.
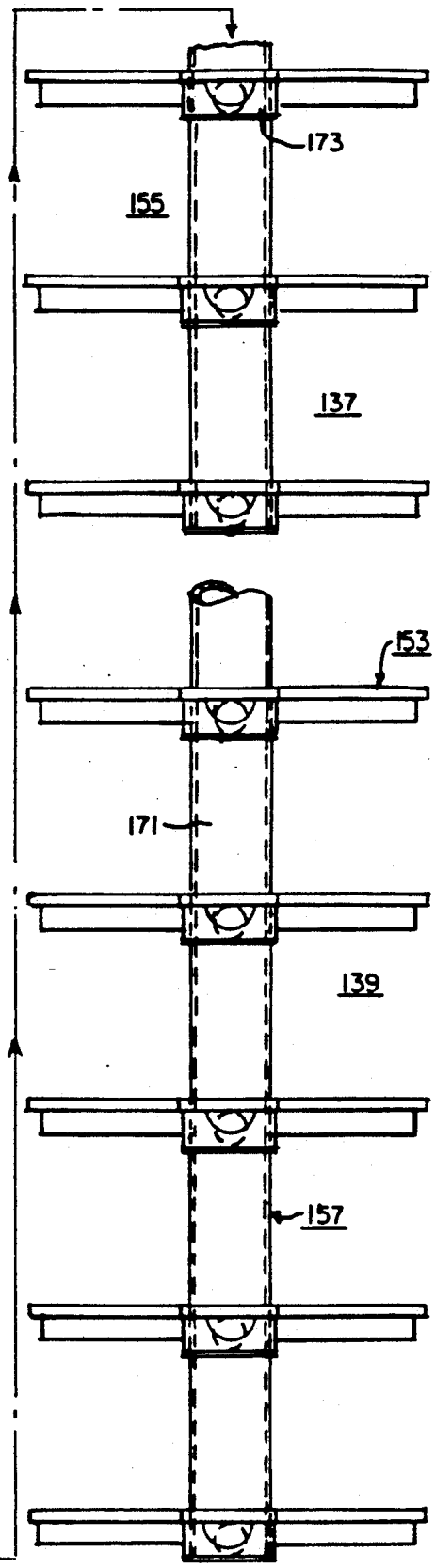

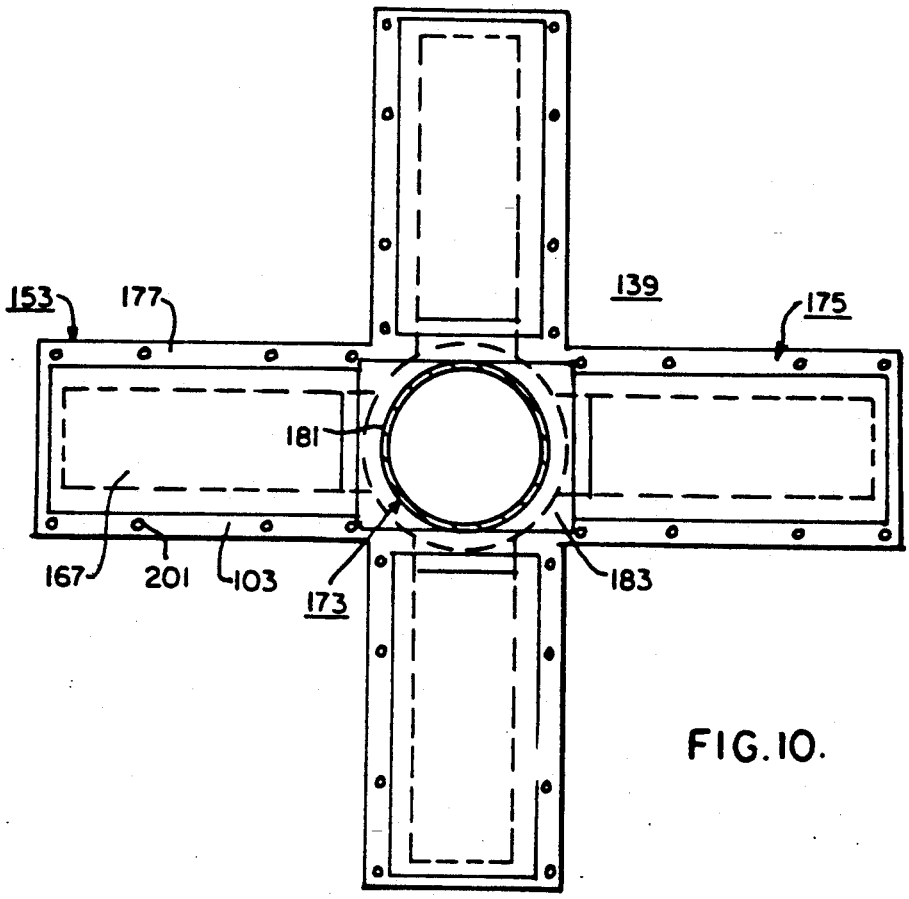
FIG. 10.
FIG. 12A.
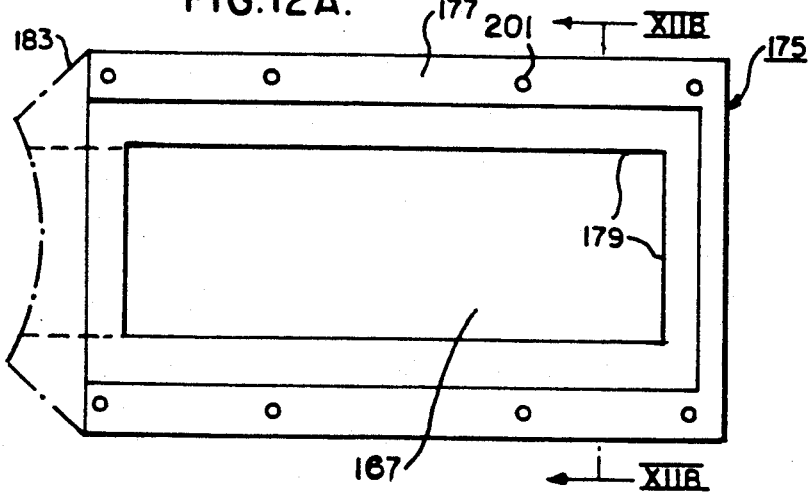
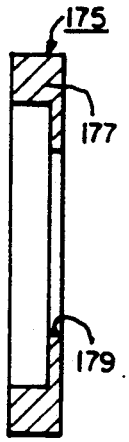
FIG. 12B.
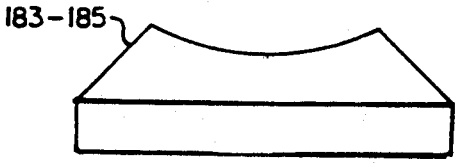
FIG. 12C.

SEPARATION OF PARTICULAYE FROM GASES PRODUCED BY COMBUSTION OF FOSSIL MATERIAL

BACKGROUND OF THE INVENTION

This invention relates to the separation of particulate from the gas, derived from the combustion of fossil fuel, which drives the turbine of a power plant. Typically, it is required that the particulate in the driving gas be reduced to 15 parts per million or less. This invention has particular relationship to the separation of particulate from the gas of pressurized fluid-bed combustion systems in which the combustion of the fuel and the removal of the particulate is integrated into a single large pressure vessel. In this application this vessel will be sometimes referred to as the "main vessel" to distinguish from auxiliary vessels mounted within the main vessel. This invention as applied to systems in which the combustion and particulate separation are integrated is unique and has significant advantages. But it is to be understood that to the extent that this invention in any of its aspects finds adaptation to power plants in which the combustion and particulate are not integrated, such adaptation is within the scope of equivalents of this application and of any patent or patents which may issue on or as a result thereof. The word "particulate" as used in this application is intended to comprehend within its scope both solid and liquid particulate.

In a typical pressurized fluid bed power generating system in which the combustion and particulate separation are integrated, the gas from the combustion which is to be processed for particle separation contains about 15,000 parts per million by mass of particulate. It is required that the outlet gas supplied to the turbines shall contain only 15 ppm or less.

Pressurized fluid bed combustion systems, in accordance with the teachings of the prior art, in which combustion and particulate separation are integrated includes in the separation chambers pairs of cyclones, each pair operating in series. The cyclone pairs are capable of separating particles whose diameter, or greatest cross dimension, exceeds about 10 microns and to reduce the particulate to about 300 ppm or more by mass. To meet the requirement of 15 ppm or less, it has in the prior-art practice been found necessary to include an electrostatic precipitator or a conventional bag-house filter for removing the residual particulate from the cold turbine exhaust gas. Because the turbines exhaust gas is substantially at atmospheric pressure, and high volumetric flow, a precipitator of large area or a large bag-house filter is demanded to meet this requirement.

It is an object of this invention to overcome the disadvantages and drawbacks of the prior art and to provide a combustion system for power generation in which the combustion and particulate separation are integrated and in whose use the particulate separation effected in the separation chamber shall reduce the particulate content in the processed gas to the required low magnitude thus dispensing with the demand for an electric precipitator or other facility house filter. It is also an object of this invention to provide a method for operating a combustion system in which the combustion and particulate separation are integrated in whose practice the particulate content of the processed gas shall meet the requirement for low particulate content.

SUMMARY OF THE INVENTION

In accordance with this invention, the separation of particulate to the required content is effected by the cooperation of roughing cyclones and porous filter means. The gas derived from the combustion is processed by the roughing cyclones to remove the larger particulate and the gas processed by the cyclones is treated in the porous filter means to remove the residual smaller particulate so that the removal of the required 99.9% or greater of the particulate from the gas derived from the combustion is achieved in the gas which flows from the porous filter means.

Specifically, there is provided in accordance with this invention the main vessel having a first compartment or section in which the combustion takes place and a second particulate-separation compartment in gas communication with the first compartment. The second compartment includes the cyclones and porous filter means which separate the particulate as required. The particulate separation compartment includes a plurality of auxiliary pressure vessels. Each auxiliary vessel contains a cyclone and a plurality of modules of ceramic porous filters. Each module includes a plurality of clusters of the filters. In the practice of this invention, the filters are cross-flow filters such as are disclosed in U.S. Pat. No. 4,343,631, Ciliberti, preferably without the corrugated sheets 14 (FIG. 1B Ciliberti). The cross-flow filter with or without the sheets is uniquely effective for cooperation with the roughing cyclone to separate the residual particulate. The cross-flow filter has a high capacity for absorbing the particulate and is at the same time inherently compact and simple in structure and operation. But the use of other ceramic porous filters, such as candle filter, to the extend that they may be adapted to the practice of the invention, for example, in clusters as disclosed in application Ser. No. 600,953, filed Oct. 22, 1990 to Gaurang B. Haldipur et al. for Filtering Apparatus and assigned to Westinghouse Electric Corp. (W. E. Case 56,211), are regarded as within the scope of equivalents of this invention.

The cyclone in each vessel is connected to the combustion chamber in the combustion compartment to receive the hot gas from this chamber. The gas processed by each cyclone is emitted form an exit tube of the cyclone and expanded into space surrounded by the modules so that the velocity of the gas is reduced. Each module is enclosed in a shroud or shield. A baffle or gas deflector is supported on the shrouds opposite the exit tube and the gas at the reduced velocity impinges on the baffle and is deflected and circulates into the shrouds from the top in contact with the cross-flow filters of the module within each shroud passing into the pores in the filters and giving up its residual particulate. The shroud enclosing each module shields the filter cluster from the turbulent up-flowing gas stream as it leaves the exit tube of the roughing cyclone. The gas spills over the top of the shroud and flows down into the filtration zone into particle-separation contact with the cross-flow filters of the module. The shroud is conical at the bottom, the cone serving as a dedicated particulate collection hopper and as ash-discharge port for the module. It is contemplated that the particulate is initially deposited as a layer in the surface pores of the filters and that as inlet gas continues to flow into the filters, its particulate builds up on this layer. The particulate formed in the filters is sometimes referred to as cake. The processed gas, cleansed of its particulate is discharged from the filters and conducted to the turbine. Periodically in periods of several minutes as disclosed in Ciliberti, the filters are cleansed of the cake.

The modules of cross-flow filters cooperative with the cyclone in each pressure vessel may be of any type, typically as disclosed in FIGS. 4 through 7 of Ciliberti. Typically, each module includes a plurality of clusters arrayed or stacked to form vertical columns. In FIG. 4 of Ciliberti the clusters extend radially about the vertical axis of a duct 34 in communication with the clean gas outlet holes of the cross-flow filters. The dirty gas passes into the lower end of the duct 34 and the clean gas passes out through the upper end of duct 34. FIG. 6 of Ciliberti discloses a plurality of modules 70, each including a cluster of cross-flow filters stacked in four columns radiating in cruciform configuration about a central duct 78 connected to the outlet openings in the filters. The duct 78 is suspended from a tube sheet. The ducts 78 conduct the clean gas out and cleaning gas pulses in.

Satisfactory separation of particulate in accordance with the invention can be achieved with the above-described cross-flow filter apparatus. The apparatus is simple in structure and operation, economical and compact so that it can readily be integrated into the particle separation chamber in effective cooperation with the combustion process. But this cross-flow filter apparatus offers obstacles to scale-up which can adversely affect the on-line effectiveness of the cleaning. By scale-up is meant the use of a larger number of cross-flow filters in a cluster. Poor cleansing of the filters can lead to high retention of the cake and unacceptable high pressure drop in the cluster.

The aspect of this invention involving the prior art modular structure arises from the realization of the role in creating problems of the single duct for transmitting the processed gas and the cleaning gas pulses. A single nozzle serves to introduce pulses into the duct. The extent to which the cleaning pulses are effective in removing the cake depends on the number of cross-flow filters in the columns of the cluster. The cleaning pulses may be effective for three filters in a column but not to scale-up to forty. The velocity and energy of the pulses of gas injected into the duct is appreciably reduced because of the larger volume of the duct and the pulses having lower energy are less effective in dislodging the cake from the filters and result in incomplete and non-uniform removal of the cake.

Where there are a large number of filters they are arrayed in a long column and redeposition of the particulate from cake dislodged at a higher elevation in filters at a lower level becomes an important adverse factor. Tests with jet-cleaned bag-house filters have shown that redeposit should be anticipated. Filter Cake Redeposition in a Pulse Jet Filter-NTIS No. PB 266233, March 1977-Harvard School of Public Health.

In cross-flow filters, the cake is deposited in horizontal slots and on being dislodged, travels first horizontally through the slots and then vertically. The transition in direction produces a substantial fragmentation of the dislodged dust cake resulting in exacerbation of the redeposit problem. Because of the redeposition, the pressure drop across the filters of a module increases as the number of rows in each column of a module increases. This drawback can be met by reducing the number of rows in a column which in turn reduces the effectiveness of the separation of the particulate.

In accordance with an aspect of this invention, there is provided a module including a plurality of clusters of cross-flow filters arrayed vertically from top to bottom. In the bottom cluster the cross-flow filters are arrayed in rows radiating from a central vertical axis, the rows being stacked in columns and the columns extending circumferentially around the whole periphery, i.e., over 360°. In the upper clusters the cross-flow filters are also arrayed in rows stacked in columns radiating from a central axis. But the columns do not extend circumferentially completely around the axis; they extend over a predetermined angle and the different clusters are rotated circumferentially with respect to each other. An important feature of the instant aspect of this invention is that each cluster is provided with a separate tube or pipe assembly in communication with the cross-flow filters of the cluster for conducting processed gas away from the filters or cleaning pulses to the filters. A tube or pipe assembly is sometimes referred to herein as a "plenum". The pulses are supplied in sequence to the separate tube assemblies or plenums. The tube assemblies are angularly displaced so that they do not physically interfere with each other. Specifically, in this module the bottom cluster has four columns of filters in a cruciform configuration and the other clusters have three columns in a T configuration. The columns in the T configuration are rotated circumferentially by an angle of 120° with reference to each other and the axes of the but assemblies are spaced 120° from each other.

Because the separate tube assemblies are of substantially smaller cross-sectional volume than the one duct of prior art modules, the reduction in the energy of the cleaning pulses by reduction in the velocity of the cleaning gas is substantially less than for prior art modules and the pulses are more effective in cleaning the filters. The cleaning pulses supplied in sequence to the separate vertically disposed cluster reduces materially the negative influence of redeposition.

BRIEF DESCRIPTION OF THE DRAWINGS

For a more complete understanding of this invention, both as to its organization and to its method of operation, together with additional objects and advantages thereof, reference is made to the following descriptions, taken in connection with the accompanying drawings, in which:

FIG. 7 is a view in side elevation showing a filter holder for supporting the cross-flow filters in the practice of this invention;

FIG. 8 is a plan view taken in the direction VIII—VIII of FIG. 7;

FIG. 10 is a plan view of the structure at a level or layer of the filter holder showing the relationship of the pads for supporting the cross-flow filters of the lowermost cluster of a module;

FIG. 12A is a plan view of a top frame of the pad shown in FIGS. 10-12 showing a mounting block in broken lines;

FIG. 12B is a view in transverse section taken along line XIIB—XIIB of FIG. 12A;

FIG. 12C is a view in isometric of the mounting block;

DETAILED DESCRIPTION OF EMBODIMENTS AND PRACTICE OF INVENTION

Figure 1:
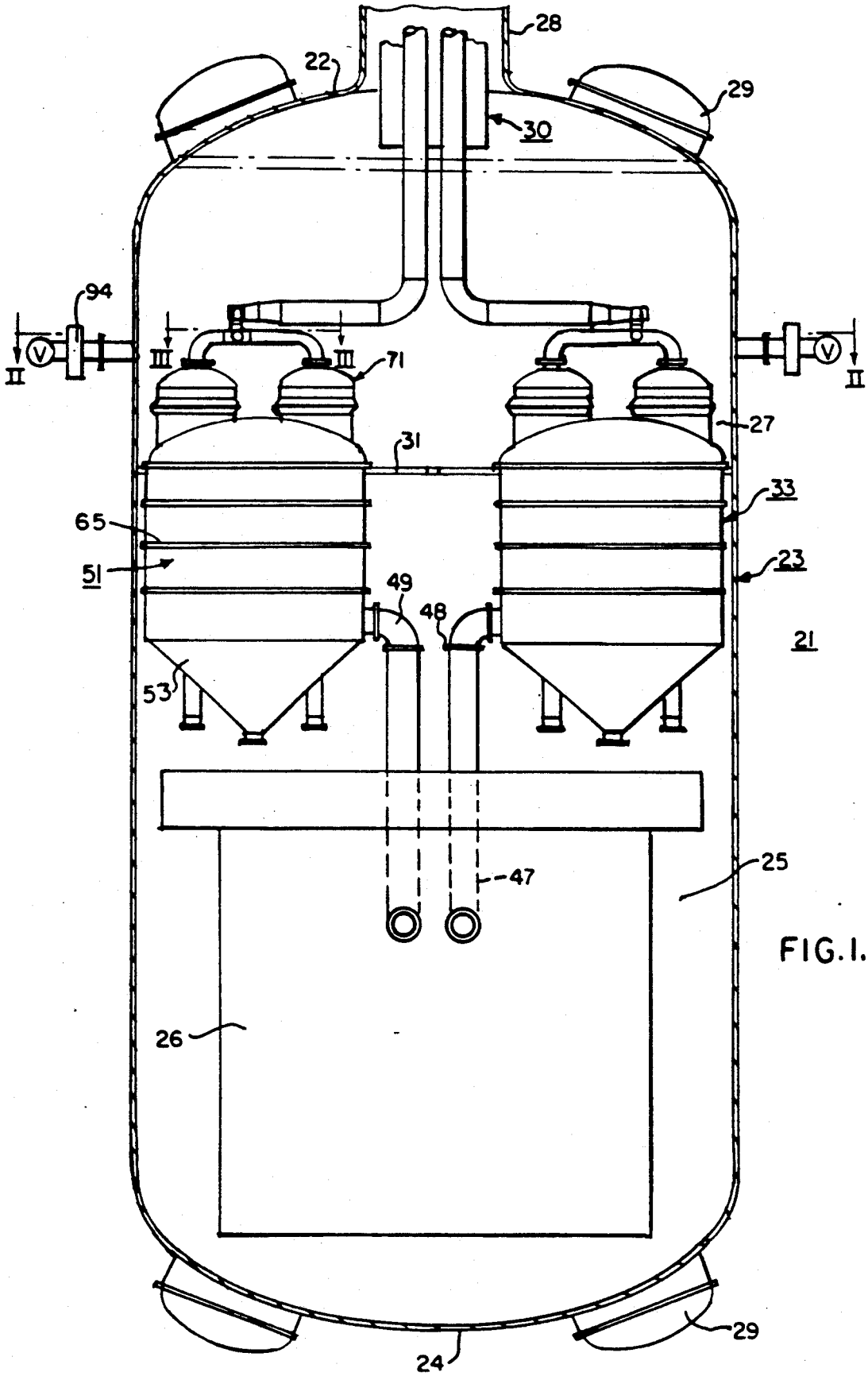
FIG. 1 is a view in longitudinal section along ling I—I of FIG. 2 showing high-temperature, high-pressure, integrated combustion and particulate separation apparatus according to this invention and for practicing the method of this invention.

The apparatus shown in FIGS. 1 through 15 is a pressurized fluid-bed combustion system 21 including a main vessel 23 (FIGS. 1 and 2) in which the combustion of a fossil fuel and the separation of particulate from the hot gas resulting from the combustion are integrated. The vessel 23 is of generally circularly cylindrical shape closed by domes 22 and 24 at the top and bottom. The vessel 23 is constructed for operation at high temperature and high pressure; typically, it is composed of mild carbon steel. The vessel has a lower compartment 25 containing a boiler 26 in which the combustion takes place and an upper compartment 27 in which the hot gas derived from the combustion is processed to separate the particulate. At the top and bottom domes 22 and 24, the main vessel has ports 29 affording access to the facilities within the vessel. The top dome has a centrally disposed opening 28 through which a coaxial conductor assembly 30 for discharging the processed clean gas to turbines (not shown) extends. Within the vessel 23, near the top, there is a hoist (not shown).

Figure 2:
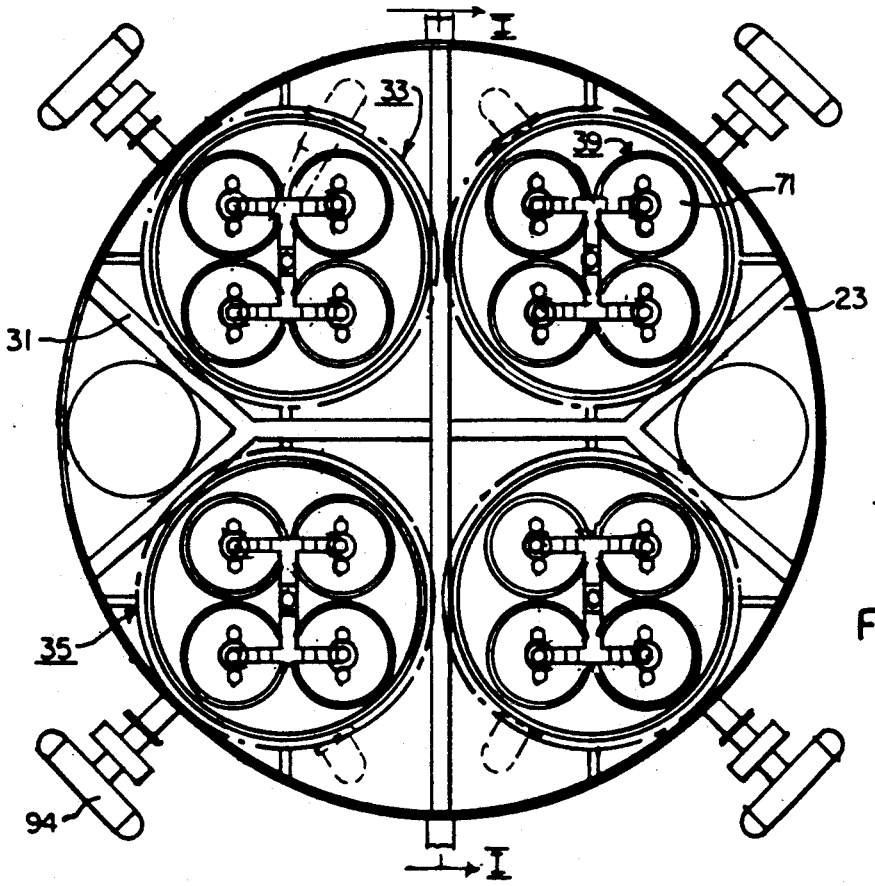
FIG. 2 is a view in transverse section taken along line II—II of FIG. 1.
Figure 3:
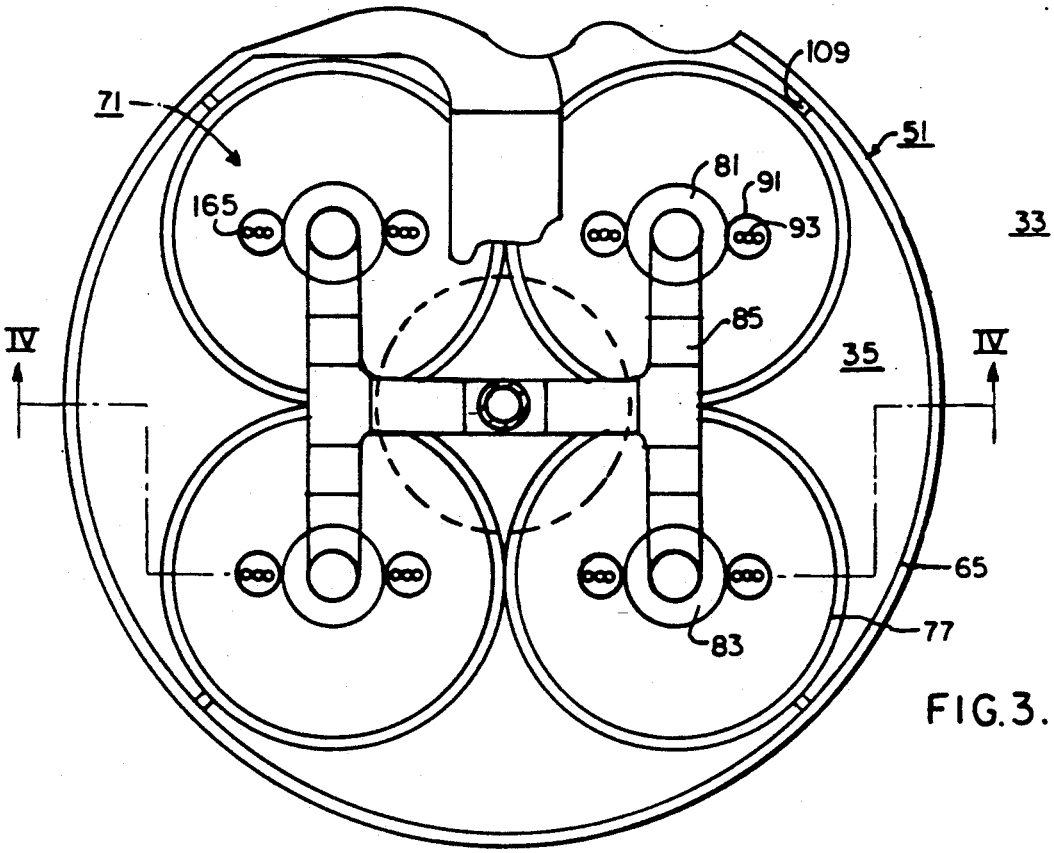
FIG. 3 is a plan view taken along line III—III of FIG. 2 showing one of the four pressure vessels (auxiliary vessels) in the particulate removal compartment of the main vessel.
Figure 4:
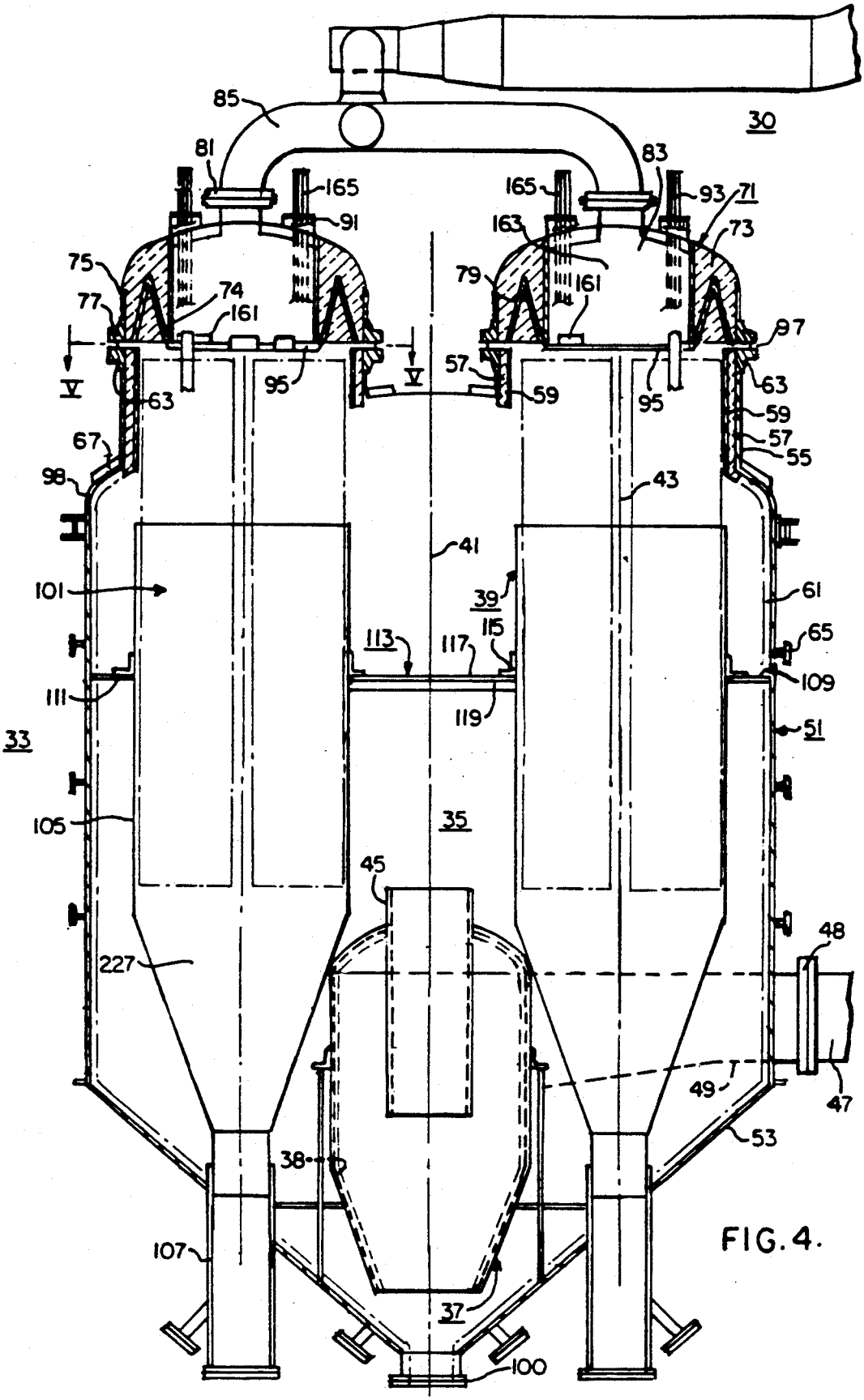
FIG. 4 is a view in longitudinal section taken along line IV—IV of FIG. 3.
Figure 5:
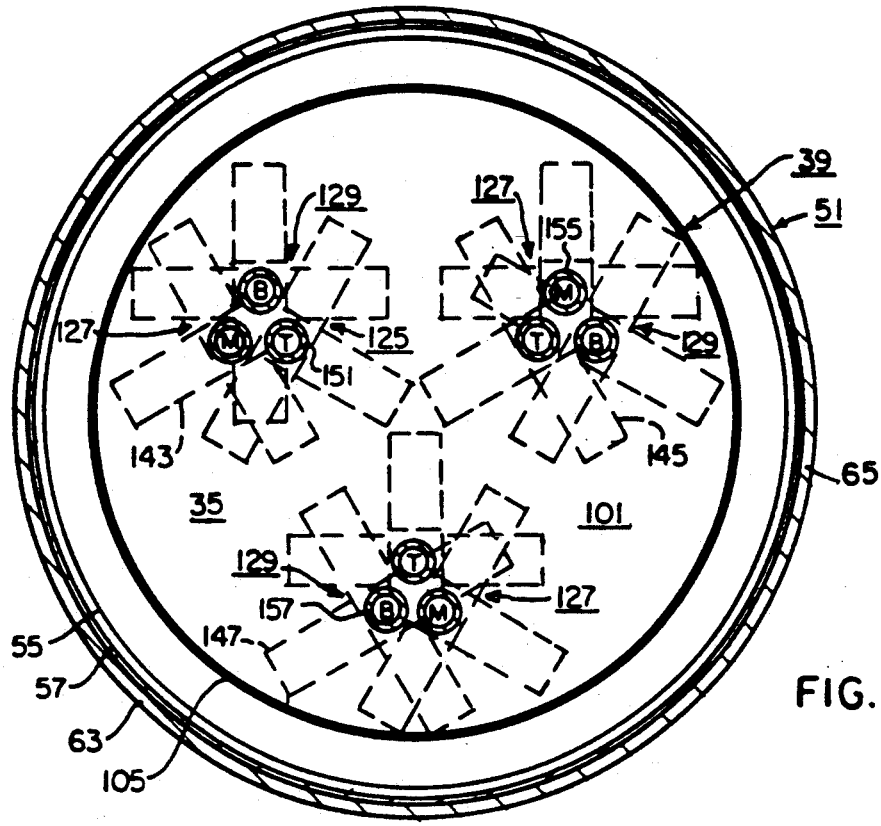
FIG. 5 is a view in transverse section taken along line V—V of FIG. 4.

In the upper compartment the vessel 23 includes a plurality of auxiliary pressure vessels 33, each of which contains a particle separation assembly 35 (FIGS. 3, 4, 5). The auxiliary pressure vessels 33 are supported by plate girders 31 (FIGS. 1 and 2) welded to the wall of the main vessel 23. Each auxiliary pressure vessel 33 has a generally circularly cylindrical body 51 terminating at the bottom in a conical shell 53 which serves as a hopper for ash. The body 51 of the vessel is typically composed of SA515-GR70 carbon steel. At the top, the body 51 has a plurality of uniformly spaced projections or nozzles 55 (FIG. 4). Each projection is engaged internally by a sleeve including an inner member 57 typically of 310 stainless steel having a fiber blanket 59 on its external surface. The blanket engages the inner surface of the projection 55. The sleeve is removable but is a tight fit so that the opening in each projection is effectively insulated. Below the nozzles 55, the body 51 has an internal lining 61, typically an intermediate weight castable refractory material. The wall of each auxiliary vessel 51 terminates below the top of the sleeve 57-59 providing a ledge at the top to which a flange 63 is welded. Externally, the body 51 is provided with stiffening rings 65 and a reinforcing ring 67 on its shoulder or head which merge into the nozzles 55.

Each nozzle 55 has a head 71. The head 71 includes a dome-shaped hollow body 73 composed of fiber thermal insulation having a radiation shield 74 of RA 330 alloy. The outer surface of body 73 includes a circularly cylindrical section merging into a segment of a sphere. Internally, the body 73 is circularly cylindrical. The externally cylindrical section is engaged by a cylindrical shell 75 composed of mild steel. The shell 75 terminates above the end of the body 73 providing a ledge to which a flange 77 is welded. An expansion member 79, typically of RA 333 alloy, is embedded in the fiber insulation 73 in the head. Externally, this member 79 has the shape of a frustum of a cone expanding downwardly and internally this member has the shape of a frustum of a cone expanding upwardly. The internal and external surfaces join at a circular apex. At the top an exit nozzle 81 extends from a spherical shoulder 83 composed of RA 253 alloy thermally insulated. The nozzle 81 passes processed gas to a manifold 85 and through the manifold to the coaxial conductor assembly 30. The manifold 85 and the related ducting typically have a diameter of 20 inches (58 cm) and are composed of RA 253 alloy. A plurality of ports 91 extend from the shoulder 83. Through each port a plurality of double-walled tubes 93 for transmitting cleaning gas pulses penetrate into the head 71. The tubes 93 are composed typically of RA 333 or equivalent high alloy metal. The tubes 93 are supplied with pulses from a compressor (not shown) through a secondary pulse accumulator 94 (FIGS. 1, 2). A circular tube sheet 95 (FIG. 4) is connected at its outer end to the inner end of the expansion cone 79. The tube sheet 95 typically fabricated from rolled alloy RA 333 and is lined by the fibrous blanket 73 and protected by the radiation shield 74. The heads 71 serve as gas-tight closures for the auxiliary pressure vessel 33. For this purpose, the flanges 77 and 63 compress between them a seal ring 97 typically of 310 stainless steel. The outer rim of the expansion cone 79 is connected to the ring 97.

Each particle separation assembly 35 includes a roughing cyclone 37 cooperative with a plurality of cross-flow filter assemblies 39 (FIG. 4). The outer wall of the cyclone is composed of 210 stainless steel having a hard-faced lining 38 of CASTOLAST Gl steel. Each cyclone is mounted within its auxiliary pressure vessel centered with respect to the filter assemblies 39; its axis 41 is equidistant from the axes 43 of the filter assemblies. Each cyclone receives the hot gas of the combustion through duct 47 (FIGS. 1, 4) to which it is connected. Duct 47 is connected to a fixture 48 in vessel 33 which is connected to the gas inlet 49 of cyclone 37. The cyclone filters out the larger particulate from the gas and discharges the resulting gas containing the residual smaller particulate through the outlet tube 45 into the region between the filter assemblies 39. As it enters this region, the gas expands and its velocity is reduced.

Typically, the length (or height) of the main vessel 23 from the region where the opening or neck 28 joins the dome 22 to the center of the lower dome 24 is 135 feet (41.148 M), and the diameter is 65 feet (19.812 M). The length (or height) of the upper compartment 27 from the lower end of dome 22 where the hoist (not shown) is located is 36 feet (10.973 M).

Typically, the temperature of the gas within the boiler 26 is 1640° F. (893.5° C.) and the temperature of the gas surrounding the boiler is 700° F. (317.5° C.). The pressure within the boiler 26 is 232 pounds per square inch (psia) (16,311.5 grams per $cm^2$) and the pressure outside of the boiler is 27 psia (1,898.3 $g/cm^2$). The pressure within the auxiliary vessels 33 is 205 psia (14,413.1 $g/cm^2$).

Typically, each auxiliary pressure vessel 33 is composed of carbon steel (SA 515 Grade 70) and has a nominal diameter of 24 feet (8.35 M) and an overall length of 48 feet (12.50 M) from the flange 100 at the bottom of pressure vessel to the outlet nozzle 81. The length from the flange 100 to the shoulder 98 is 34.5 feet (10.52 M) (FIG. 4). The top of the vessel 33 is dished and it supports typically four nozzles 55 of 8.5 feet (2.59 M) diameter reinforced by the sleeve 57-59. Each nozzle locates the seal flanges 63 and 77 and the tube sheet 95.

Typically, the refractory linings 61 (FIG. 4) includes a 7-inch (17.78 cm) thick layer of intermediate-weight castable material such as RESCO RS33A and a 2-inch (5.08 cm) thick hardface lining such as Harbison Walker "CASTOLAST" G.

Each cross-flow filter assembly 39 includes a plurality of cross-flow filter modules 101 (typically three) enclosed within a gas distribution shroud 105 (FIGS. 4, 5, 6) composed of 310 stainless steel. The shroud 105 is a hollow circular cylinder open at the top and terminating in a frustum of a cone which serves as a hopper for ash and is connected at the bottom to a tube 107 through which ash is disposed of. The shrouds 105 within an auxiliary vessel 33 are supported from the body 51 of the vessel 33 by radial rib brackets 109 which are welded to the walls of the body. The rib brackets 109 are secured to the shroud 105 by angles 111. A baffle or inertial impactor plate 113 is supported from the shrouds 105 by angles 115 secured to the shrouds in the region between them opposite the outlet tube 45 of the cyclone 37 (FIG. 4). The impactor plate 113 includes a base 117 of 310 stainless steel and a hardface lining 119 of typically CASTALOY-gl facing the tube 45. Typically, the base 117 is 0.5 inches (1.27 cm) thick and the lining 119 is 1-inch (2.54 cm) thick. The overall length of the shroud 105 is 21 feet, 2 inches (6.46 M). The diameter of the cylindrical part of the shroud is 12 feet, 4 inches (2.29 M). The length of the conical part of the shroud is 7 feet, 5 inches (2.26 M).

Each module 101 includes a vertical array of clusters of cross-flow filters 124 as generally disclosed in Ciliberti, typically a top cluster 125, a middle cluster 127 and a bottom cluster 129 (FIGS. 5, 6). his invention is not confined to three clusters as shown, there may be more or less than three clusters. The filters 124 of each cluster 125, 127, 129 are stacked in a vertical array or in columns on a filter holder 131 (FIG. 7) having separate stacked support sections 135, 137, 139, respectively, for the top cluster 125, the middle cluster 127 and bottom cluster 129. In the top cluster 125 and the middle cluster 127, the cross-flow filters 124 are stacked in columns in generally T configuration; a centrally disposed column 141 from whose inner end columns 143 and 145 extend in opposite directions. In the bottom cluster 129, the filters 124 are stacked in cruciform configuration with four columns 147 extending diametrically oppositely in pairs spaced 90° with respect to each other. The middle cluster 127 is rotated with respect to the top cluster 125 by 120° as shown in FIG. 5. It is to be understood that this angle may be different than 120°. Where there are more than two upper clusters (such as 125 and 127) in a module, the angle is substantially less than 120°. In the module 101 as shown in the drawing which is typical, there are 5 filters 124 in each column; there are 50 filters in each module, 30 in the top and middle clusters 125, 127 and 20 in the bottom cluster 129.

Figure 9:
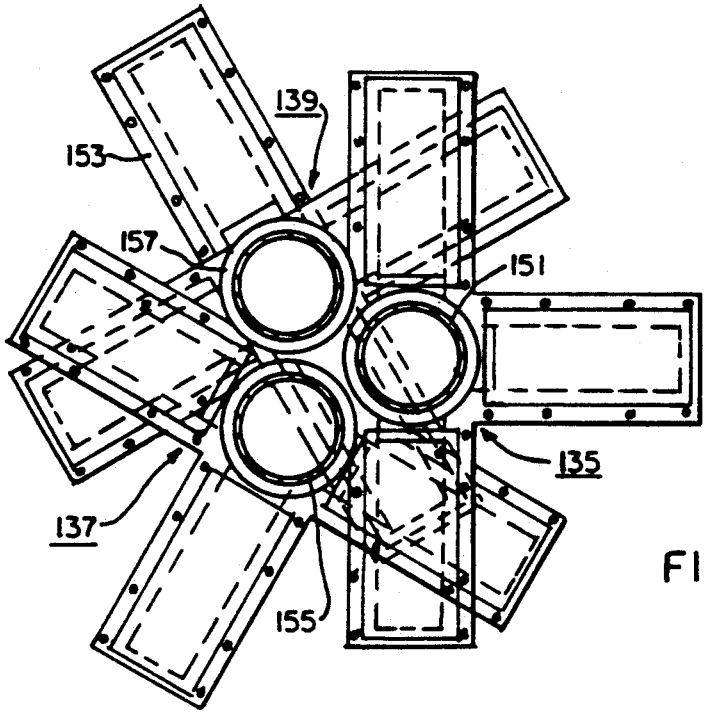
FIG. 9 is a view in section taken along line IX—IX of FIG. 7.

The holder 131 for the cross-flow filters will now be described with reference to FIGS. 7, 8, 9. The configuration of the support sections 135, 137, 139 of the holder corresponds to the configuration of the clusters 125, 127, 129 of the module 124. The support section 135 for the top cluster 125 includes a pipe assembly or plenum 151 from which three columns of pan pads or pans 153 are suspended stacked in T configuration. The middle support section 137 or the middle cluster includes a pipe assembly 155 from which three columns of pads 153 are suspended stacked in T configuration. The bottom support section 139 includes a pipe assembly 157 from which four columns of the pads 153 are suspended stacked in cruciform configuration. The pipe assemblies 151, 155, 157 typically each has a diameter of 6 inches (15.24 cm) and are composed of 310 stainless steel. The pipe assemblies are spaced 120° from each other. The pipe assemblies 151, 155, 157 are open at the top and closed at the bottom.

The axis 158 (FIG. 6) of the middle support section 137 is rotated with respect to the axis of the top support section 135 by the same angle (typically 120°) as the middle cluster 127 is rotated with respect to the top cluster. At the top, the pipe assemblies 151, 155, 157 of each module 101 are sealed to a flange 161 (FIG. 6) which is sealed to the tube sheet 95 (FIG. 4) with each set of the pipe assemblies opening into the region 163 of the head 71 through which the processed gas and the pulses to clean the filters 124 transmitted. A separate tube 165 of each bundle 93 of the tube through which the cleaning pulses are supplied is associated with each pipe assembly. Because the upper clusters are of T configuration, the pipe sections do not interfere with each other.

Each pad 153 is essentially a pan of rectangular shape defining a receptacle 167 of semicircular cross-section closed at the ends (FIGS. 10, 11, 12, 14). The pads are mounted on pipe assemblies 151 and 155 in rows of T-shaped configuration to form the columns 135 and 137 and on the pipe 157 of cruciform configuration to form the column 139.

Figure 11:
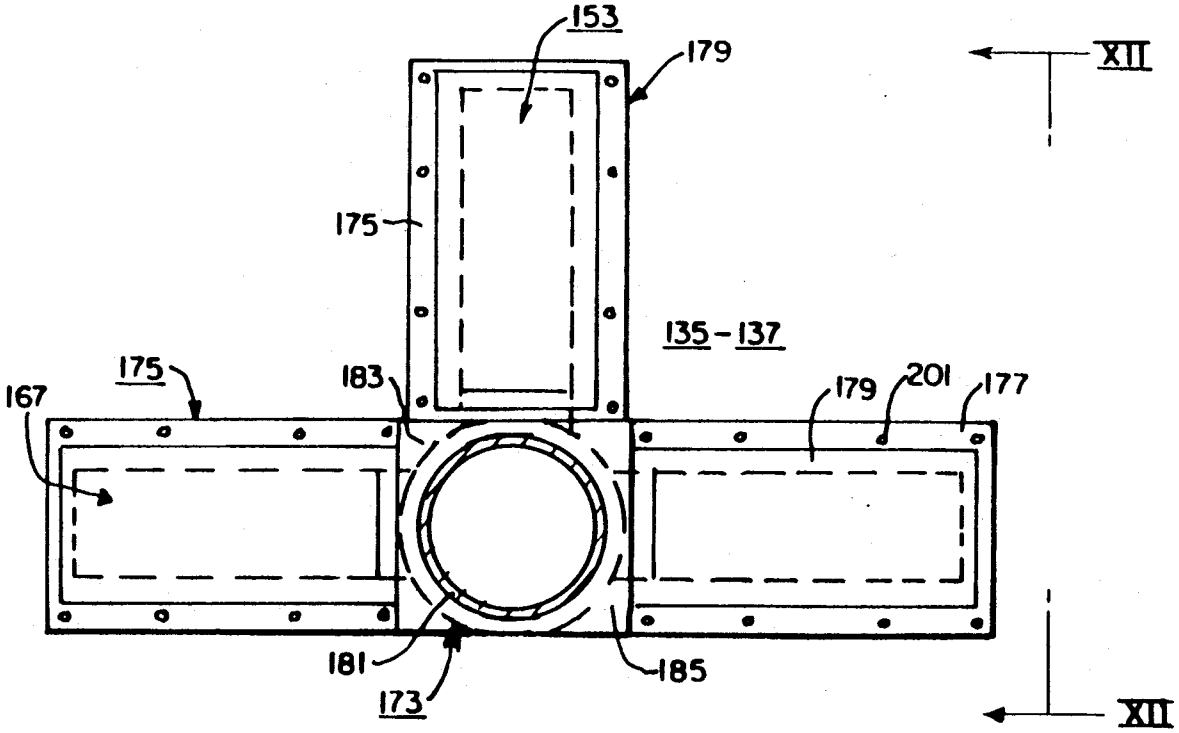
FIG. 11 is a plan view similar to FIG. 10 showing the relationship of the pads for supporting the cross-flow filters of a cluster above the lowermost cluster.
Figure 13A:
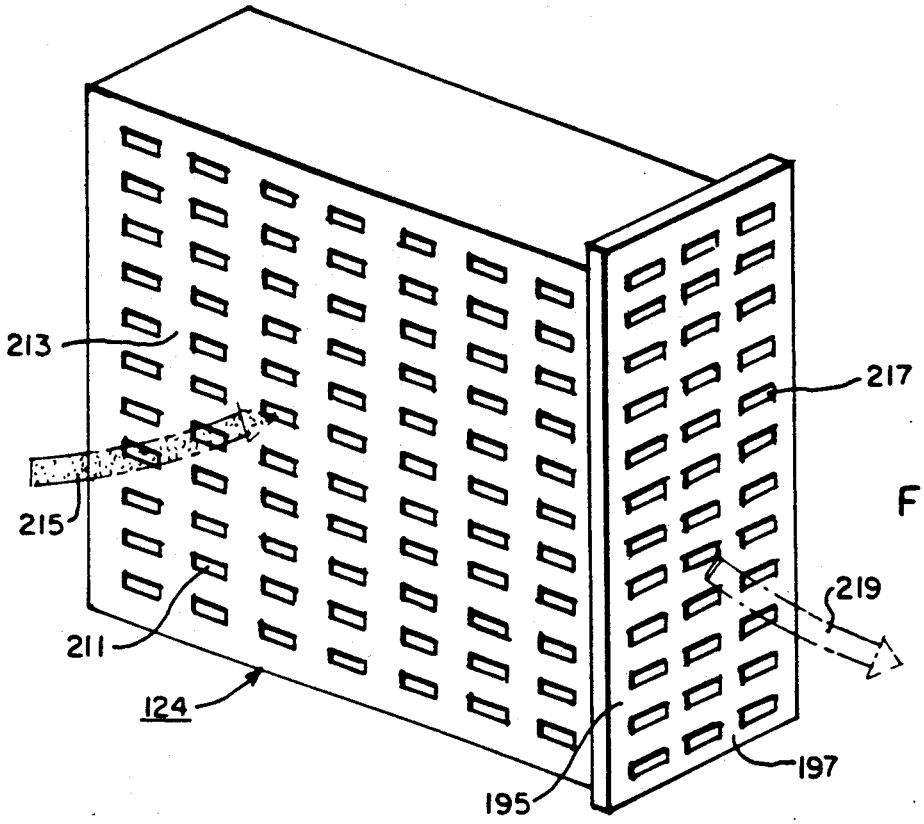
FIG. 13A is a diagrammatic view in isometric illustrating the operation of a cross-flow filter when separating particulate from gas.
Figure 13B:
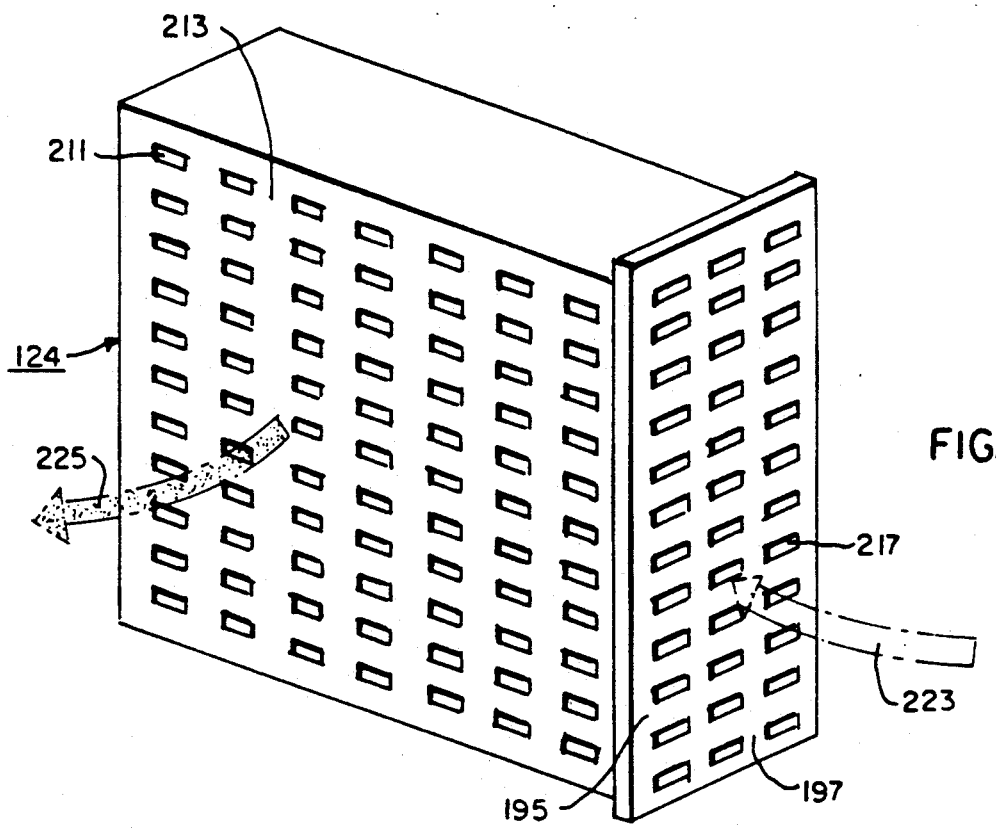
FIG. 13B is a view in isometric illustrating the operation of a cross-flow filter during the cleaning of the filter.
Figure 14:
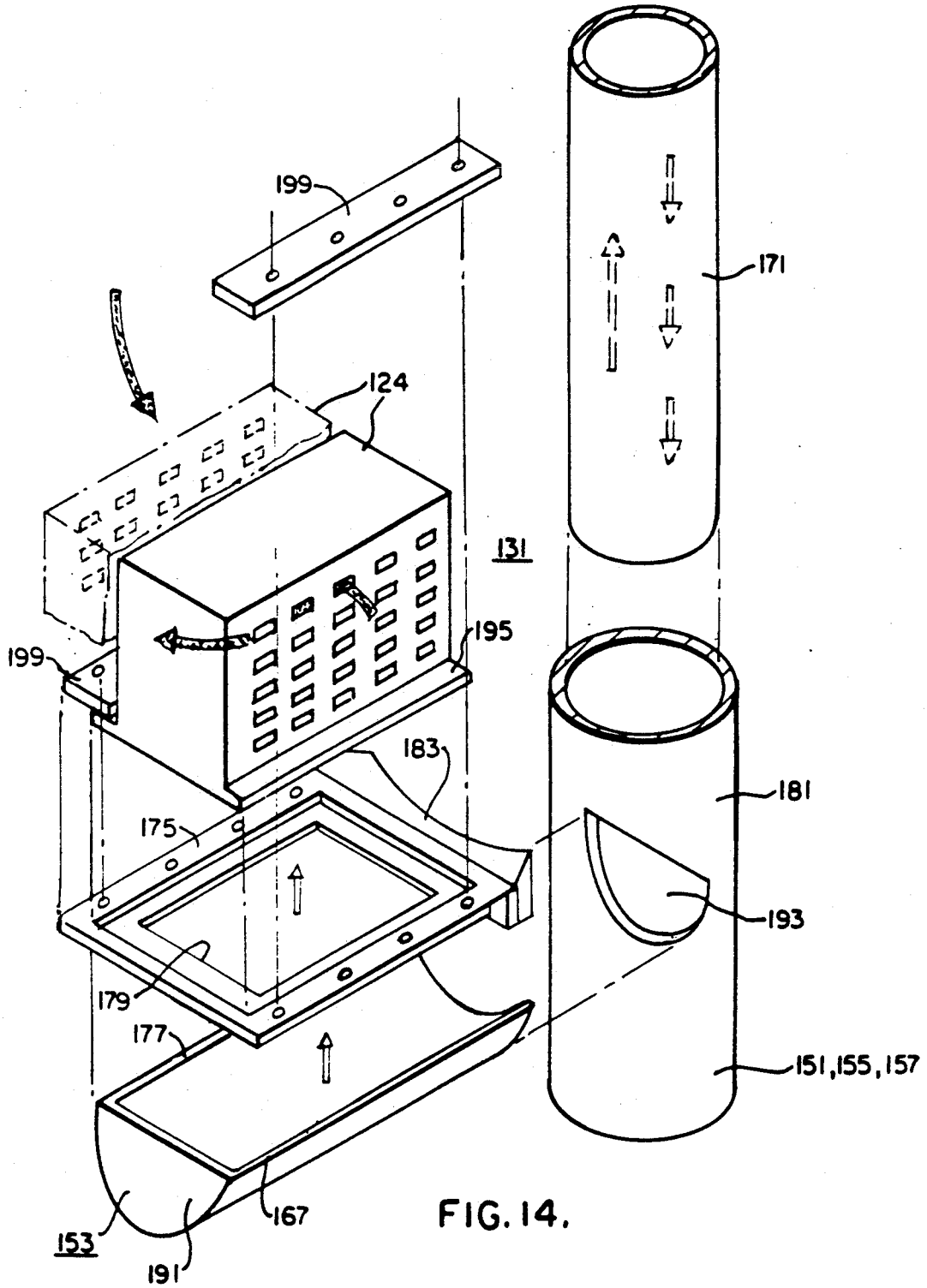
FIG. 14 is a diagrammatic exploded view in isometric illustrating the cooperation of the filter holder and a cross-flow filter in the operation of apparatus in accordance with this invention.

The structure of the pads 153 and their connection to the pipe assemblies 151, 155 and 157 will now be described with reference to FIGS. 10 through 14. Each pipe assembly or plenum includes a pipe section 171 connected between couplers or sleeves 173 which define successive levels or rows of the sections 135, 137, 139 (FIG. 7). The receptacle 167 is a semicircular cylindrical member formed by severing a cylinder diametrically. A framelike member 175 (FIGS. 10, 11, 12A) is welded across the upper rim of the receptacle 167. The upwardly extending rim 177 (FIG. 12B) of the member 175 forms a flange extending along the length of the receptacle 167 and the portion extending inwardly from the end of the flange 177 forms a set 179. Each coupler 173 includes a circularly cylindrical tubular member 181 (FIGS. 10, 12, 14) having an inside diameter such to form a tight fit with the outside diameter of a pipe section 171. Each pipe section is welded to the members 181 at successive layers or levels of each cluster 125, 127, 129. Each member 181 is encircled by blocks 183 and 185 with the ends of adjoining blocks abutting each other as shown in FIGS. 10 and 11. In case of the upper sections 135 and 137 of the holder 131, three blocks 183 extend from the inner ends of frame-like members 175 to which they are welded (FIG. 12A) and the fourth is a separate block 185 (FIG. 11). Each receptacle 167 is sealed at its outer end 191. At its inner end it is open and is sealed pressure tight to an opening 193 (FIG. 14) in the coupler 173 which has the same contour as the receptacle (FIG. 14). The opening 193 is in communication with the sections 171 of the pipe assemblies 151, 155, 157, which are also sealed pressure tight to the couplers 173 and are thus in communication with the inner volume 163 of the head 71, the outlet nozzle 81 and the manifold 85.

A flange 195 (FIGS. 12, 13A, 13B, 14) extends from the long sides of that face 197 of each filter 124 through which the processed gas flows out and the cleaning pulses flow in. The filter 124 is seated on the pad 153 with this flange seated in the seat 179 of the frame-like member 175. Each filter 124 is held on the pad by a clamping bar 199 (FIG. 12) which is secured by bolts (not shown) threaded into the bolt holes 201 in the member 175. The clamping bar 199 effectively seals the filters into the pad and establishes communication between the filters 124 and the manifold 85 and also with the tube 93 (FIG. 4).

In the practice of this invention, the velocity of the gas containing the particulate, which emerges from outlet tube 45 of the cyclone 37 in each vessel 33, is reduced when the gas passes into the greater volume above the tube 45. This gas driven by pressure in the boiler 26 is deflected by the baffle 113 and passes upwardly substantially uniformly entering the shrouds 105 through the top. In the shrouds, the residual particulate containing gas flows into the slots 211 on the sides 213 of each filter 124 as represented by the dotted arrow 215 (FIG. 13A). The slots 211 penetrate through the opposite sides of the filter 124 and the residual-particulate-containing gas circulates through these slots. The sides 213 are sometimes referred to herein as the inlet sides. The particulate is initially deposited on the surfaces of the slots 211 and as the process continues, builds up on these surfaces. The processed gas penetrates through the pores of the filter and flows into the receptacle 167 through the slots 217 in face 197 and thence out through the associated pipe assembly 151, 155 and 157 and the manifold 85 as clean gas as represented by the white arrow 219. This process is driven by the high pressure in the associated pressure vessel 33. The slots 217 are herein sometimes referred to as outlet slots. These slots 217 are closed at the face opposite face 197 (face on left with the reference to FIGS. 13A and 13B).

Figure 6:
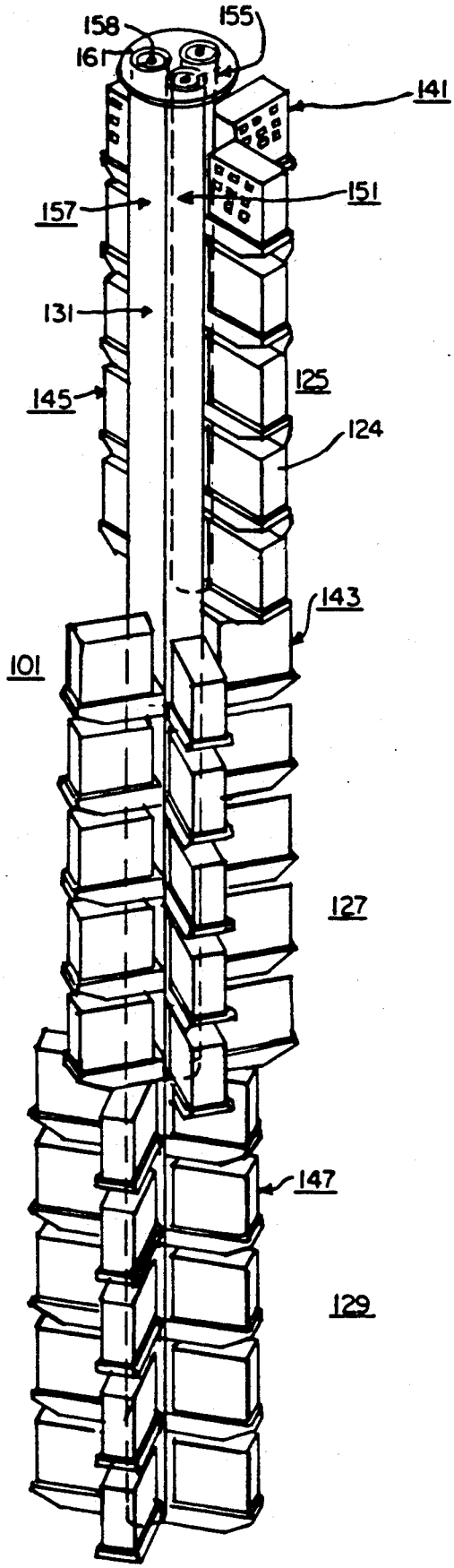
FIG. 6 is a view in isometric of a module of cross-flow filters, in accordance with an aspect of this invention, of the type which is included in the pressure vessel.
Figure 12:
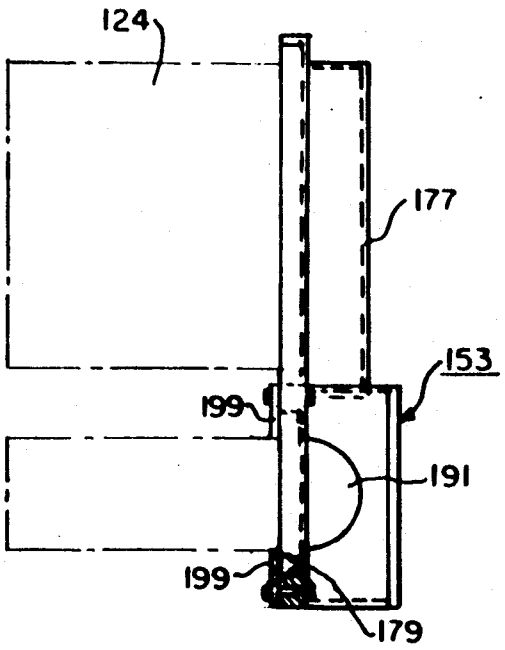
FIG. 12 is a view in side elevation taken in the direction XII—XII of FIG. 11 showing the cross-flow filters in broken lines.
Figure 15:
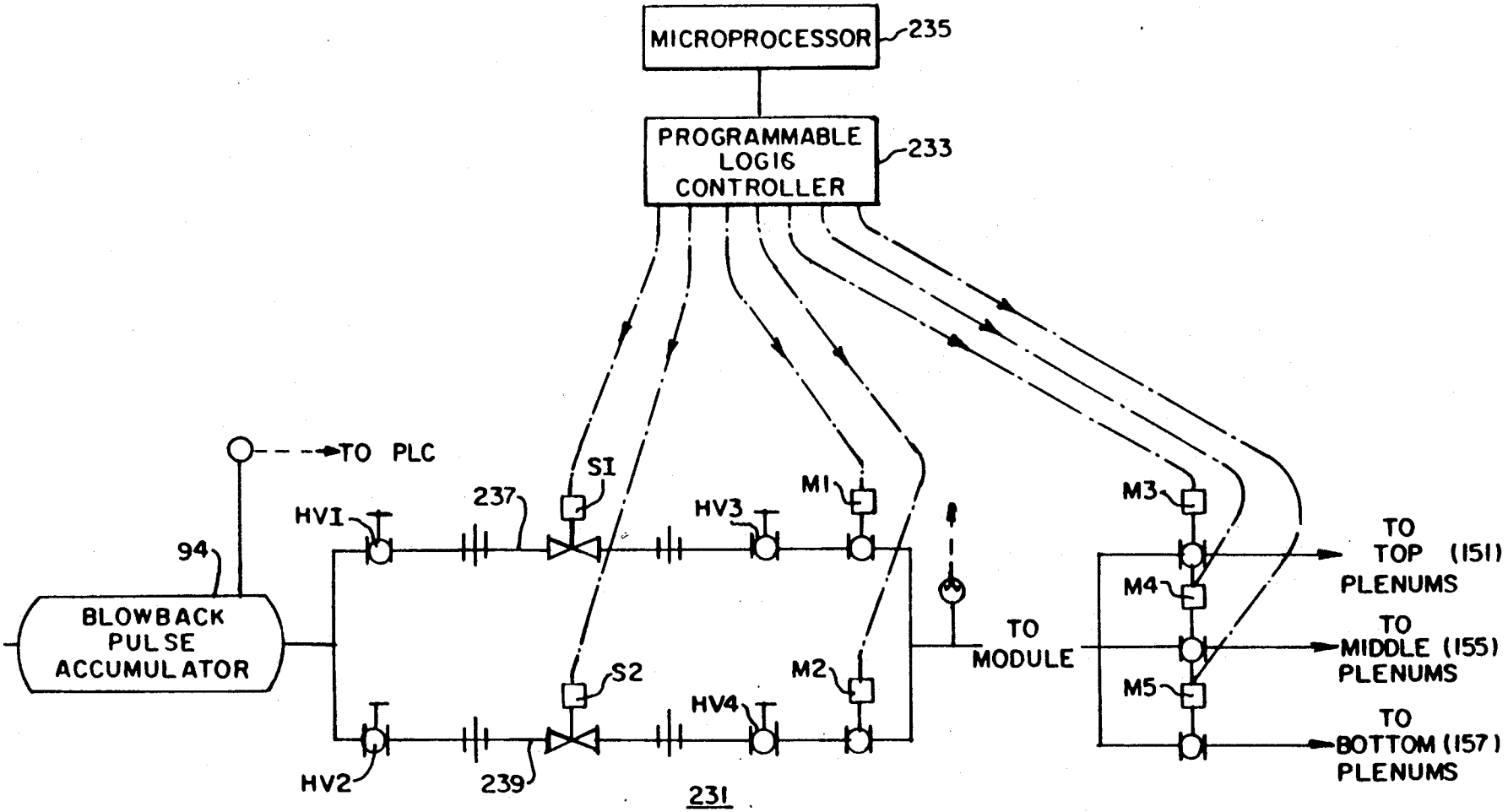
FIG. 15 is a schematic showing the pneumatic circuit for controlling the flow of cleaning pulses.

The control of the cleaning pulses and their sequencing will now be described with reference to FIG. 15. The pulses for each auxiliary vessel 33 are supplied from the accumulator 94 (FIGS. 1, 2, 15) through an instrumentation and control system (I&C) 231 controlled by a programmable logic controller (PLC) 233 which receives commands from a microprocessor 235. A separate I&C controls each module 101. The PLC 233 has a data logger for monitoring system operation and sequencing the pulse cleaning actions for each pipe assembly or plenum 151, 155, 157 (FIG. 6). To insure a high degree of reliability, the I&C system 231 includes redundant pneumatic valve networks 237 and 239 and appropriate sensors (not shown) to diagnose valve failures and verify that critical logic permissives have been attained. Networks 237 and 239 include, respectively, normally closed manually operable valves HV1, HV2, HV3 and HV4 for use in emergencies, solenoid valves S1 and S2, and motor-operated isolation valves M1 and M2. Each plenum or pipe assembly 151, 155, 157 is controlled by a motor-operated isolation valve M3, M4, M5 respectively.

The sequence of operations, which is repeated, is as follows:

1. Open M1, M2 and M3.
2. Open S1 typically for 200 to 500 milliseconds. Gas flows into plenum 151 and through the top cluster 125. If the pulsing through cluster 125 is satisfactory,
3. Close S1 and M3.

Next 4. Open M4 (M1 and M2 are open and M3 is closed).

5. Open S1 typically for 200 to 500 milliseconds. Gas flows into plenum 155 and through cluster 127. If the pulsing through cluster 127 is satisfactory,
6. Close S1 and M4.

Next 7. Open M5 (M1, M2 are open and M3 and M4 are closed.

8. Open S1 typically for 200 to 500 milliseconds. Gas flows into plenum 157 and through bottom cluster 129. If the pulsing through cluster 129 is satisfactory,
9. Close S1 and M5.

A sequence of pulsing has been completed. At this stage, M1 and M2 are open and M3, M4, M5 are closed. The sequence may now be repeated.

If S1 fails to open at any stage of the operation, S2 opens. If S1 fails to close in any stage of the operation, M1 is closed and the pulsing takes place through S2 and M2.

The cleaning gas pulses in each tube 165 of the bundles 93, driven by pressure, flow into the pipe assemblies 151, 155, 157 and then through the receptacles 167 into the slots 217 of the face 197 as represented by the white arrow 223 (FIG. 13B) and thence through the pores of the filter and out through the slots 211 of the face 213 as represented by the dotted arrow 225. The cleaning gas blows out the cake from the surfaces of the slots and it flows as ash through the conical portions 227 of the shrouds 101. The inflow of processed gas is interrupted during the intervals during which the cleaning gas is flowing.

The relationship between the module 101 in accordance with this invention and prior art modules will now be described. The module 101 has significant advantages over prior-art modules of cross-flow filters. Prior-art modules include a number of filters, for example, 40 suspended from a support or plenum, typically, there are four columns in cruciform configuration, each column including ten filters. A single nozzle supplies high-pressure pulses to the plenum to clean the 40 filters. While cleaning of this type may be effective for a module having relatively short columns (for example, of three filters each), the dynamics and mechanical capacitance effects associated with a module having filter columns of substantially greater length (for example, of 10 filters each) would cause the pulse intensity to be reduced by reason of pressure drop causing incomplete or non-uniform dislodgement of the cake. The number of filters per column which can be effectively cleaned would be limited.

Studies with bag filters, which are analogous to cross-flow filters, have shown that redeposition of the particulate released from higher filters on lower filters, particularly where the columns are of substantial length, necessarily also occurs. Where the module is served by pulses from a single nozzle, the redeposition magnifies the pressure drop of the pulses by as high a factor as 9, thus compelling resort to columns of limited length.

In the practice of this invention, the single plenum module of the prior art is replaced by a module 101 having separate clusters 125, 127, 129, each served by a separate tube assembly or plenum 151, 155 and 157. It is of unique advantage to schedule the pulses sequentially. This has the advantage that the cake dislodged by earlier pulses in the sequence from an upper cluster 125 and 127 which deposits on a lower cluster 127 or 129 is dislodged by later pulses in the sequence.

Typical conditions which apparatus and practice of this invention must meet are presented in the following Table I.

TABLE I

| | |
|---|---|
| Pressure external of the = boiler | 27 psi (0.38 g/cm$^2$) |
| Temperature of gas in = Boiler | 1640° F. (893.5° C.) |
| Ash holdup capacity = | 8 hr. |
| Temperature skin of = auxilary vessel 33 | 675° F. (357.5° C.) |
| Skin of auxiliary vessel = heat loss | <150 BTU/hr/ft$^2$ (406,889 gm. cal./hr/M$^2$) |
| Gas flow rate | 165,240 acfm (4680 acMm) |
| Inlet loading of particulate to roughing cyclone 37 of each auxiliary vessel 33 | 15000 ppm |
| Outlet loading from each auxiliary vessel 33 | ≦15 ppm |
| Module 101 | <5 psi (.07 gm/cm$^2$) |

Typical design specification for a pulse cleaning system for each auxiliary vessel 33 of a 330 megawatt pressurized fluid bed combustion system are tabulated in the following Table II.

TABLE II

| |
|---|
| Dimensions of the tank of the secondary accumulator 94 fed from a compressed air supply of capacity of 5400 lb. per hr. (2449 kg/hr) - diameter 2 ft. (.609 M), length 5 ft. (1.52 M) |
| Valve type - 3 Ported/Atkomatic Series 35000 |
| Valve dimension - 2 inch (5.08 cm) |
| Nozzle dimension - 1.5 inch (3.81 cm) |
| Venturi dimension - diameter 4 inches (10.16 cm) 20°/20° |
| Plenum 151, 155, 157 diameter - 6 inches (15.24 cm) |
| Pulse piping loss - 112 velocity heads – kinetic energy of the flowing gas = $\frac{v^2}{2g}$ where v is velocity and g gravitational constant. |
| Operating pressure 940 psig (1.334 kg/M$^2$) - 2000 psig (2.84 kg/M$^2$) |
| Pulse gas temperature 70° F. (31.5° C.) - 300° F. (149° C.) |
| Mass flow of pulse - 4.5 lb/2.05 kg) |
| Pulse gas usage - Nominal (2500 ppm particulate inlet - 180 lb/hr (81.82 kg/hr |
| Maximum (15000 ppm particulate inlet - |

TABLE II-continued

| |
|---|
| 1080 lb/hr (490.91 kg/hr |

The invention disclosed in FIGS. 1 through 15 can be readily adapted to accommodate the longest heights of the plenums 151, 155, 157 as required by the particle redeposition considerations. For example, if the maximum allowable free-fall length is 4 filters 124 per column instead of 5 filters 124 per column as disclosed, there would be only 4 filters in each column and the total of filters 124 in a module would be 40, i.e., 12+12+16.

Figure 16:
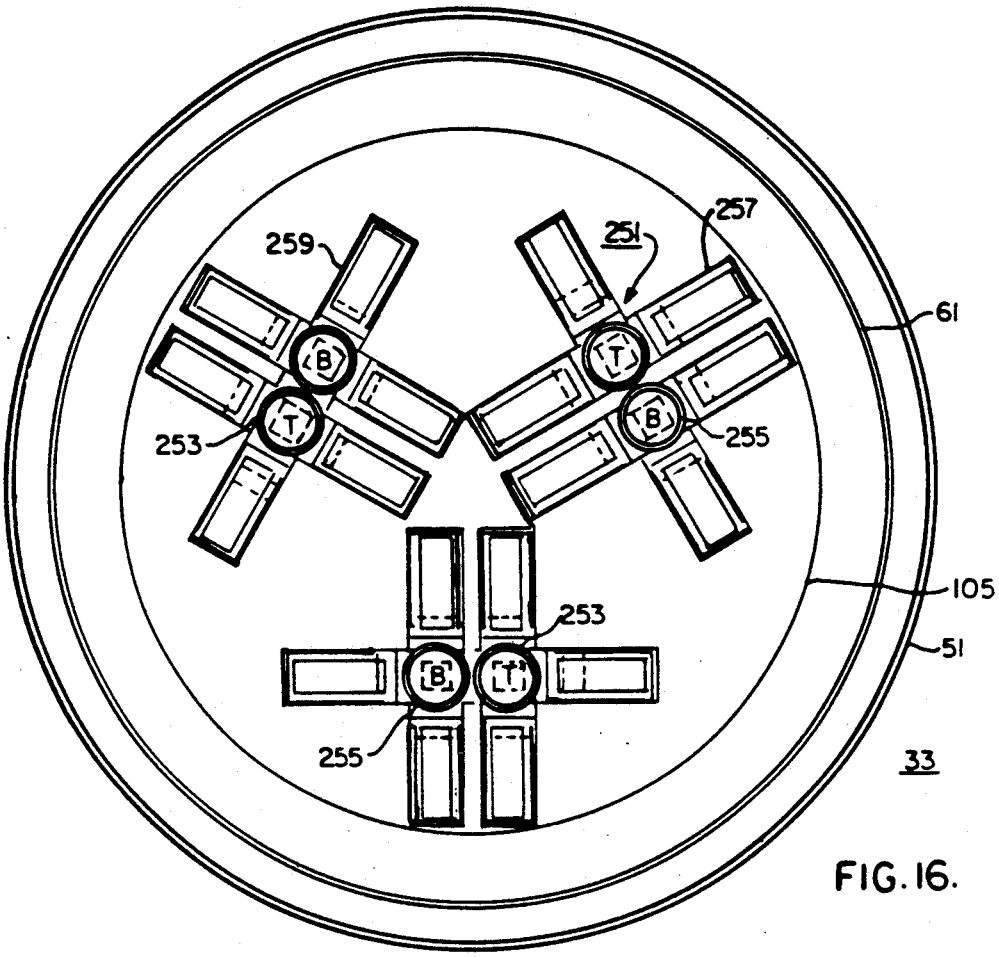
FIG. 16 is a diagrammatic plan view illustrating a modification of this invention.

A modification of this invention is shown in FIG. 16. In this case, there are only two clusters per module, a top module T and a bottom module B. In FIG. 16, the holders 251 of the filters 124 in this modification are shown. The holders are mounted in the shroud 105 within the vessel 33. Each holder includes a top plenum 255 (labeled B). Three pads 257 radiate in each row in T configuration from the top plenum 253 and four pads 259 radiate in each row in cruciform configuration in the bottom plenum 255. Typically, each column may be 5 filters in height. There are then 35 filters per module, i.e., 15+20, and 105 filters 124 in a vessel. In a typical situation for demonstrating the feasibility of the invention in filtering 13050 ACFM (369.6 ACMM) containing 2500 ppm particulate, the pressure vessel 33 has an outside diameter of 113.5 inches (288.29 cm), the internal liner has an outer diameter of 102.8 inches (261.11 cm) and the shroud 105 has an outside diameter 85.5 inches (217.17 cm).

Figure 17:
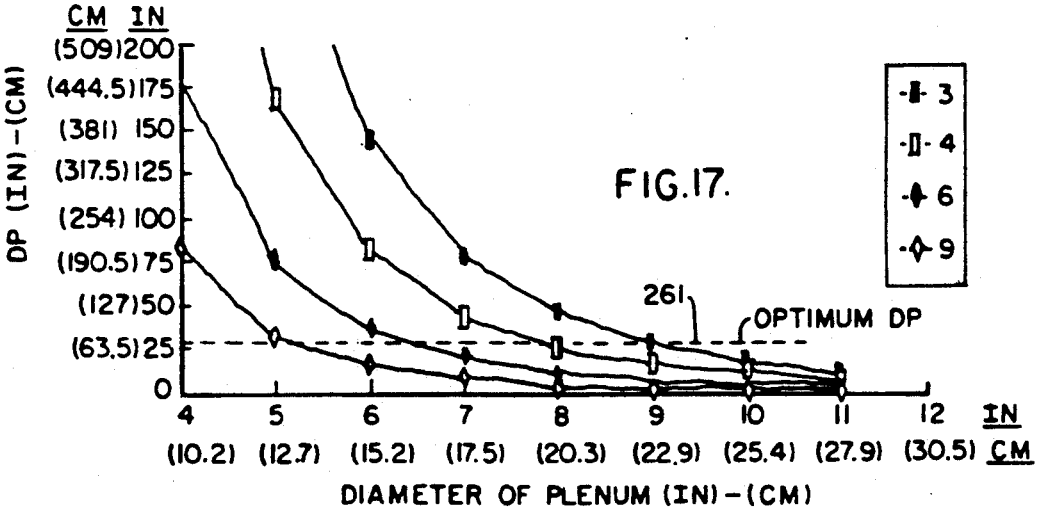
FIG. 17 is a graph showing the computed losses for various configurations of modules.

FIG. 17 presents a family of graphs showing the relationship between the diameter of the plenums or pipe assemblies and the pressure drop for four modules having 3, 4, 6, 9 plenums. Diameter is plotted horizontally in inches and pressure drop is plotted vertically in inches of water. The broken line 261 shows the optimum permissible pressure drop.

While preferred embodiments of this invention have been disclosed herein, many modifications thereof are feasible. This invention is not to be restricted except insofar as is necessitated by the spirit of the prior art.

We claim:

1. Power generating apparatus including a main vessel having a first compartment containing means for generating a gas by combination of a fossil fuel, a second compartment containing means for separating particulate from the gas, and conductor means for transmitting the generated gas from said first compartment to said second compartment; said particulate-separating means including roughing cyclone means for separating the larger particulate from the generated gas leaving residual particulate in the treated gas, means, connecting said conductor means to said roughing cyclone means to transmit the generated gas to said roughing cyclone means to be treated by said roughing cyclone means, porous filter means, cooperative with said roughing cyclone means, to receive the treated gas from said roughing cyclone means to separate the residual particulate in the treated gas emitted from said roughing cyclone means, and means, connected to said main vessel, cooperative with said porous filter means for transmitting the gas processed by said porous filter means; the said apparatus being characterized by particulate separating means in which the roughing cyclone means includes a plurality of cyclones, each cyclone cooperative with a plurality of porous filter assemblies of the porous filter means, said plurality of porous filter assemblies to receive the treated gas from said each cyclone with which they are cooperative and to separate the residual particulate therefrom.

2. The generating apparatus of claim 1 characterized by that each of the plurality of porous filter assemblies includes a plurality of ceramic cross-flow filter means and by means mounting said cross-flow filter means in the path of the treated gas emitted by the roughing cyclone cooperative with said plurality of porous filter assemblies.

3. The generating apparatus of claim 2 wherein each of the cross-flow filter assemblies includes a plurality of ceramic filter blocks; the said apparatus being characterized by that each of the cross-flow filter assemblies includes modules of said blocks, each module including a plurality of blocks aligned by the mounting means in the path of the treated gas from the cyclone.

4. The generating apparatus of claim 1 wherein the second compartment includes auxiliary vessel means, the said apparatus being characterized by that a roughing cyclone and a plurality of porous filter assemblies are mounted in the auxiliary vessel means with the cyclone nested within the porous filter assemblies with the porous filter assemblies positioned to receive the treated gas from the cyclone in residual-particulate filtering relationship therewith, and by that the conductor means from the first compartment is connected to the cyclone through the auxiliary vessel.

5. The generating apparatus of claim 4 characterized by that the second compartment includes a plurality of auxiliary vessels, each vessel including therein a roughing cyclone and a plurality of porous filter assemblies cooperative with said cyclone.

6. Apparatus for separating particulate from a gas including an auxiliary vessel having therein a roughing cyclone for treating the gas to separate the larger particulate from the gas leaving residual particulate in the treated gas, a plurality of porous filter assemblies cooperative with said roughing cyclone for receiving the gas treated by said roughing cyclone and substantially separating the residual particulate from the gas, and means, connected to said auxiliary vessel cooperative with said plurality of porous filter assemblies, for transmitting the gas processed by said porous filter assemblies from which said residual particulate has been substantially separated.

7. The apparatus of claim 6 characterized by that the cyclone has an outlet of restricted area and the volume into which the gas is emitted from said outlet is of substantially greater area; whereby the velocity of the treated gas received by the porous filter assemblies is substantially reduced.

8. The apparatus of claim 6 characterized by a baffle interposed in the path of the treated gas emitted from the cyclone for deflecting the gas into effective filtering contact with the porous filter assemblies.

9. The apparatus of claim 6 wherein each of the plurality of porous filter assemblies includes a plurality of cross-flow filters aligned in the path of the treated gas emitted from the cyclone in particulate-filtering relationship with the treated gas.

10. The apparatus of claim 6 wherein each of the plurality of porous filter assemblies includes a plurality of modules, each module including a plurality of cross-flow filters mounted in an array, the said apparatus being characterized by a shroud enclosing each assembly at least in part, the roughing cyclone being related physically to the shrouds for said plurality of modules so that the shrouds guide the gas treated by the roughing cyclone into effective residual-particulate-removing contact with the cross-flow filters.

11. The apparatus of claim 10 wherein the auxiliary vessel has ash outlet tubes, the shrouds and the modules which they enclose are mounted so that their longitudinal axes define the apexes of a polygon in transverse cross section and each shroud has a hopper connected to a said outlet tube, said apparatus being characterized by that the roughing cyclone is nested in the region external to the hoppers.

12. The apparatus of claim 10 wherein the shrouds and the modules which they enclose are mounted so that the intersections of their longitudinal axes with a plane perpendicular to these axes define the apexes of a polygon characterized by a baffle supported by the shrouds in the path of the gas emitted by the cyclone so as to deflect the emitted gas into the region of the auxiliary vessel outwardly of the shrouds and thence through the tops of the shrouds in residual-particulate-removal contact with the treated gas.

13. The apparatus of claim 6 wherein each of the plurality of porous filter assemblies includes a plurality of modules, each module including a plurality of cross-flow filters mounted in an array, the said apparatus also including means for supplying gas for cleaning said cross-flow filters; said apparatus being characterized by that the cross-flow filters of each module are mounted in an array in a plurality of clusters and by separate tubular means cooperative with the cross-flow filters of each cluster for both, conducting the gas processed by said cross-flow filters outwardly of said cross-flow filter and for conducting the gas for cleaning said cross-flow filter inwardly of said cross-flow filter.

14. The apparatus of claim 13 wherein the cleaning gas-producing means include means connected to the tubular means for supplying the cleaning gas in pulses to the cross-flow filters of the clusters sequentially.

15. A module for separating particulate from the gas produced by the combustion of fossil fuel in the generation of power; said module including; a plurality of clusters, each cluster including a plurality of porous cross-flow filters aligned, each cross-flow filter having inlet openings for receiving gas containing particulate and outlet openings in gas communication with the inlet openings through the pores of said filters, gas conductor means, means for mounting said module with said clusters aligned and with the said cross-flow filters in processed-gas communication with said gas conductor means, the said module being characterized by that the gas conductor means includes a separate conductor in gas communication with the cross-flow filters of each cluster.

16. The module of claim 15 characterized by that the separate conductors are physically cooperative with the cross-flow in such a way as to be capable of conducting processed gas received by the inlet openings outwardly of the associated clusters and of conducting gas for cleaning the cross-filters inwardly of the associated clusters.

17. The module of claim 15 characterized by that each cross-flow filter is in the shape of a parallelepiped with the inlet openings for the gas from the combustion extending through said parallelepiped between one set of opposite surfaces and penetrating through said opposite surfaces whereby said gas is circulated through said inlet opening and the outlet openings for the processed gas extending into another surface of said parallelepiped, said other surface being at an angle to the surfaces of said one set, said outlet openings being closed at the surface of said parallelepiped opposite said other surface.

18. The module of claim 15 characterized by that in at-least-one of the clusters near one end of said module the cross-flow filters extend over an angle less than 360° around the axis of the module and in at-least-another cluster near the opposite end of said module the cross-flow filters extend 360° around the axis of the module.

19. The module of claim 18 characterized by that in the at-least-one cluster, the cross-flow filters are mounted defining a generally T configuration and in at-least-another cluster the cross-flow filters are mounted in a generally cruciform configuration.

20. The method of separating particulate from the gas produced by combustion of fossil fuel in the generation of power; said method comprising: separating the larger particulate from said gas by a roughing cyclone leaving residual particulate in the gas treated by said cyclone, distributing said gas treated by said roughing cyclone among a plurality of porous filter assemblies, and separating the residual particulate from the treated gas by means of said porous filter assemblies.

21. The method of claim 20 characterized by that in distributing the treated gas from the cyclone among the porous filter assemblies, the velocity of the treated gas from said cyclone is reduced.

22. The method of claim 20 characterized by that the distribution of the treated gas from the cyclone among the porous filter assemblies is effectuated by projecting the gas from the cyclone on a baffle to deflect the gas to the porous filter assemblies.

23. The method of cleaning the cross-flow filter of a module for separating particulate from a gas produced by the combustion of fossil fuel for power generation, each module including a plurality of clusters, each cluster including a plurality of cross-flow filters; said method including: transmitting cleaning pulses through said cross-flow filters and being characterized by that the cleaning pulses are transmitted through the cross-flow filters of the clusters of the plurality of clusters in succession.

24. A module for separating particulate from the gas produced by the combustion of fossil fuel in the generation of power; said module including: a plurality of clusters, each cluster including a plurality of cross-flow filters arrayed in circumferential rows with the rows in columns, and, tubular means connected to the cross-flow filters of the clusters, for conducting from the clusters gas processed by the filters and for conducting into the clusters gas for cleaning said filters, the said module being characterized by that the tubular means includes a separate tube assembly for each cluster, and by that the rows of filters of the clusters at the end of the module extend throughout the whole circumference of the cluster and the rows of filters of the other clusters extend over an angle substantially less than 360° of the cluster and by that the rows of filters of different ones of said other clusters are rotated with reference to each other over a predetermined angle to preclude physical interference between said tube assemblies.

25. The module of claim 24 wherein viewing the module positioned vertically, the plurality of clusters include a top cluster, a middle cluster, and a bottom cluster, the rows of the bottom cluster extending throughout the whole circumference of the cluster and the rows of the top and middle cluster each extending over an angle substantially less than 360° of the circumference of the cluster; characterized by that the angle less than 360° is about 120° for both the top and middle cluster and by that the columns of the middle cluster are rotated by about 120° with respect to the top cluster.

26. The module of claim 25 wherein the separate tube assemblies connected to each of the clusters are spaced circumferentially so that their vertical axes are at an angle of about 120° with respect to each other.

27. The apparatus of claim 13 characterized by means, connected to the separate tubular means, for controlling the conduction of the cleaning gas so that the cleaning gas is conducted in succession through the clusters.

28. In power generating apparatus including means for separating particulate from the gas for driving the generators produced by the combustion or fossil fuel; the said separating means including at least one module having a plurality of clusters, each cluster having a plurality of cross-flow filters through which the gas is conducted in particle-separation relationship whereby particle cake accumulates in the filters; means for cleaning the filters, the said filter-cleaning means including means, connected separately to each cluster, for supplying gas to the filters of each cluster for dislodging the particle cake from the filters of said each cluster, the gas-supplying means including means for supplying the gas to the clusters in pulses in succession.

29. The apparatus of claim 1 characterized by that each roughing cyclone cooperative with a plurality of porous filter assemblies is centered with respect to the porous filter assemblies with which it is cooperative.

30. Apparatus for separating particulate from a gas produced by the combustion of fossil fuel including: an auxiliary vessel having therein a roughing cyclone, means, cooperative with said roughing cyclone, for transmitting said gas through said roughing cyclone for treatment therein to separate substantially the larger particulate from said gas, said roughing cyclone transmitting the treated gas having residual smaller particulate therein, a plurality of porous filter assemblies positioned in said auxiliary vessel to receive said treated gas transmitted by said roughing cyclone and to separate substantially said residual smaller particulate therefrom, means, interposed in said auxiliary vessel between said roughing cyclone and said plurality of porous filter assemblies, responsive to the treated gas transmitted by said roughing cyclone, for distributing said treated gas from said roughing cyclone among said plurality of porous filter assemblies and means, connected to said auxiliary vessel cooperative with said plurality of porous filter assemblies, for transmitting the gas treated by said plurality of porous filter assemblies from which said residual smaller particulate has been substantially separated.

* * * * *